US007263326B2

(12) United States Patent
Amagai

(10) Patent No.: US 7,263,326 B2
(45) Date of Patent: Aug. 28, 2007

(54) PAPER FEED CASSETTE FOR IMAGE FORMING APPARATUS

(75) Inventor: Yoshihide Amagai, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/949,747

(22) Filed: Sep. 24, 2004

(65) Prior Publication Data

US 2005/0191102 A1 Sep. 1, 2005

(30) Foreign Application Priority Data

Sep. 24, 2003 (JP) ..... 2003-332489
Aug. 30, 2004 (JP) ..... 2004-251084

(51) Int. Cl.
*G15G 15/00* (2006.01)

(52) U.S. Cl. ..... 399/393; 399/388

(58) Field of Classification Search ..... 399/393, 399/389, 387, 388, 361
See application file for complete search history.

(56) References Cited

U.S. PATENT DOCUMENTS 5,137,269 A * 8/1992 Yamamoto ..... 271/145
5,157,448 A * 10/1992 Lang ..... 399/23
5,231,459 A * 7/1993 Jang et al. ..... 399/124
5,454,553 A * 10/1995 Firl et al. ..... 271/4.04
5,995,800 A * 11/1999 Ahn ..... 399/361
6,155,680 A * 12/2000 Belon et al. ..... 347/104
6,708,971 B1 * 3/2004 Sasaki et al. ..... 271/117

FOREIGN PATENT DOCUMENTS

JP 04-029082 3/1993

* cited by examiner

*Primary Examiner*—Anthony H. Nguyen
(74) *Attorney, Agent, or Firm*—Reed Smith LLP

(57) ABSTRACT

Storage box for storing stacked recording mediums comprises a two-part structure consisting of in-apparatus mounting portion and out-apparatus mounting portion which are coupled via a rotational support mechanism. In-apparatus mounting portion and out-apparatus mounting portion of storage box are kept integrally coupled via lock mechanisms for locking in-apparatus mounting portion and out-apparatus mounting portion of storage box in normal use. On the other hand, when an improper handling is performed such that the whole image forming apparatus is lifted up by gripping the out-apparatus mounting portion of paper feed cassette, lock mechanisms are released to pivot out-apparatus mounting portion thereby to avoid the improper handling so that paper feed cassette which is exposed outside from the image forming apparatus is prevented from damages and the risk of the whole apparatus falling is avoided beforehand.

8 Claims, 12 Drawing Sheets

【Fig. 1】
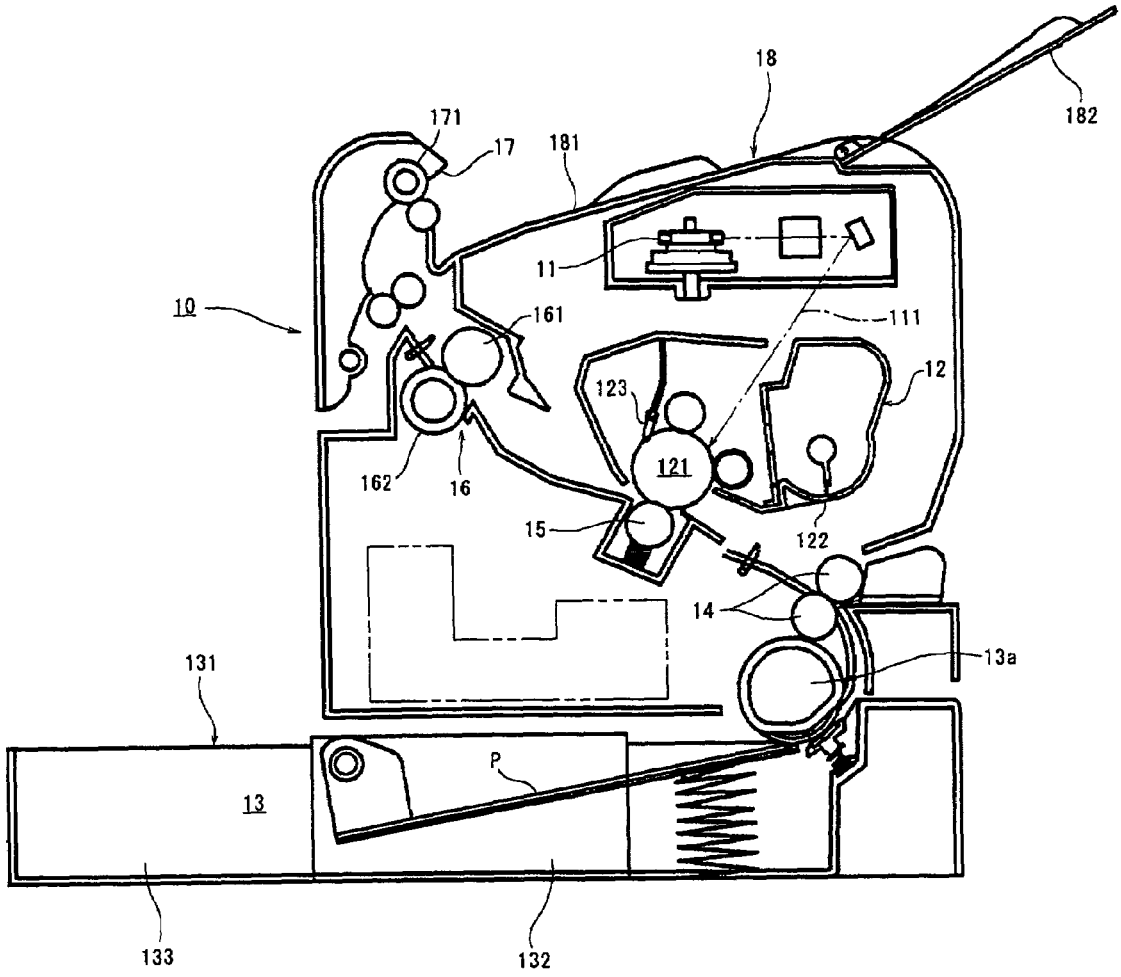

【Fig. 2】
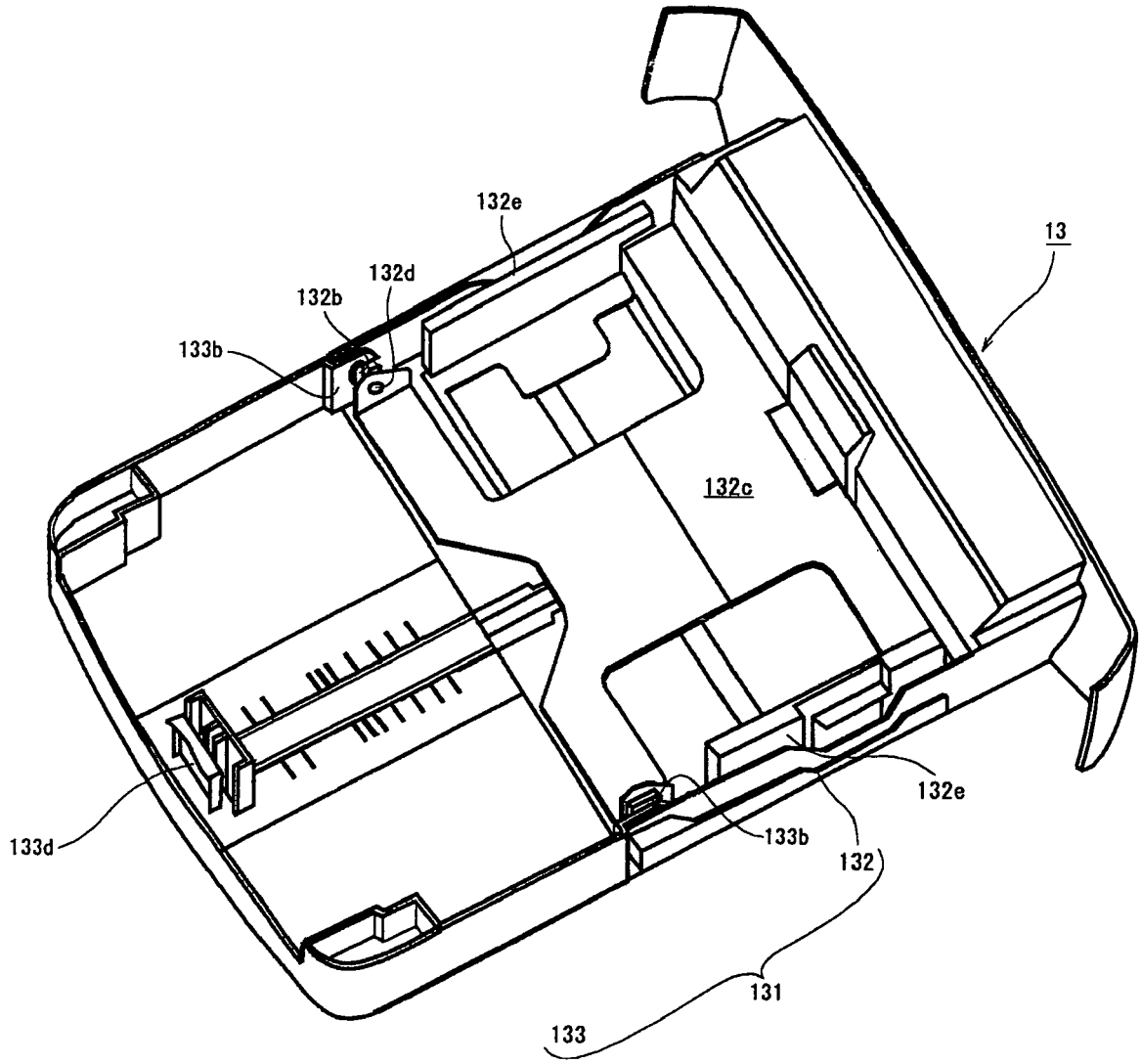

【Fig. 3】
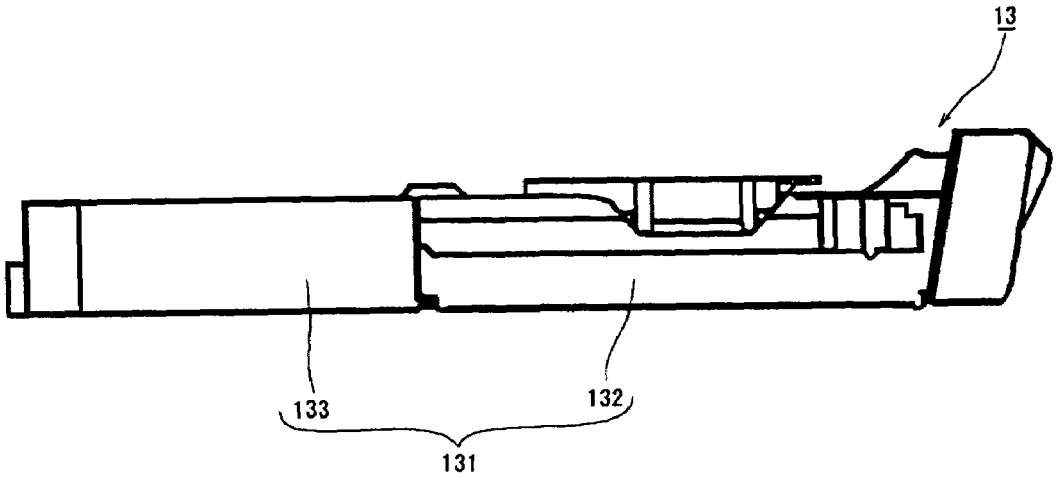

【Fig. 4】
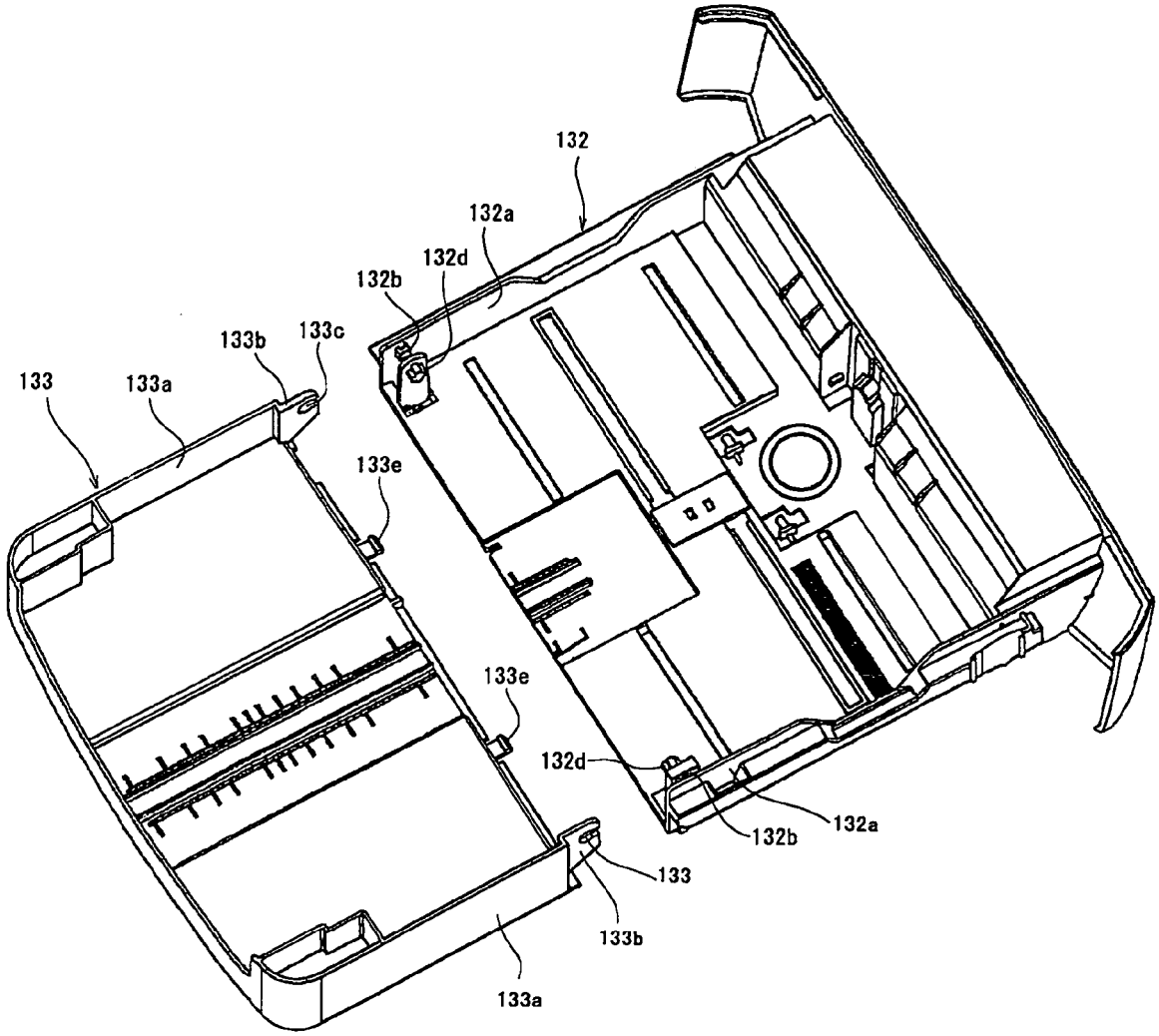

【Fig. 5】
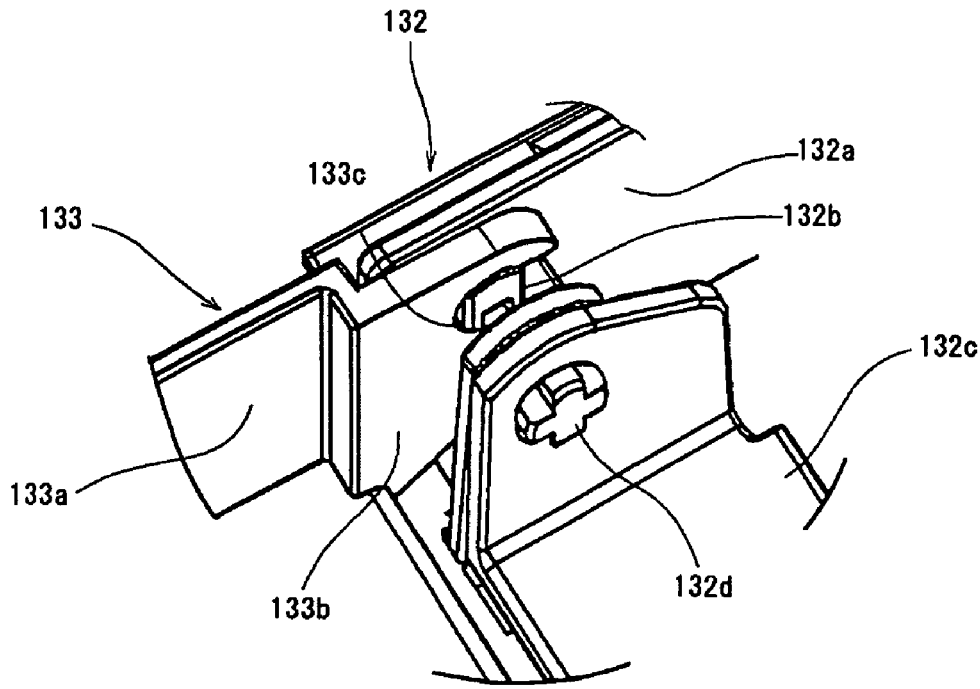

【Fig. 6】
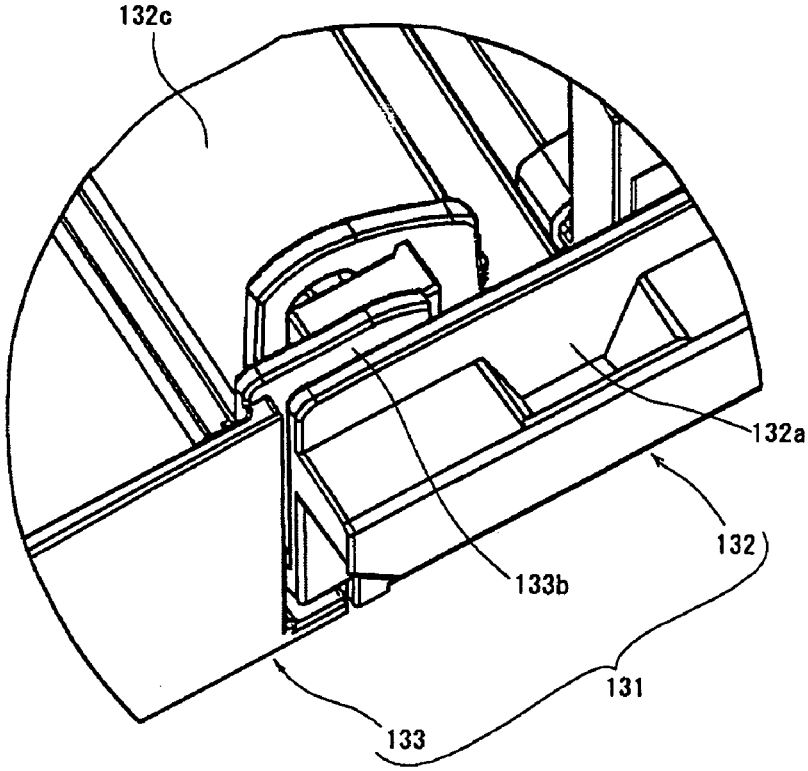

【Fig. 7】
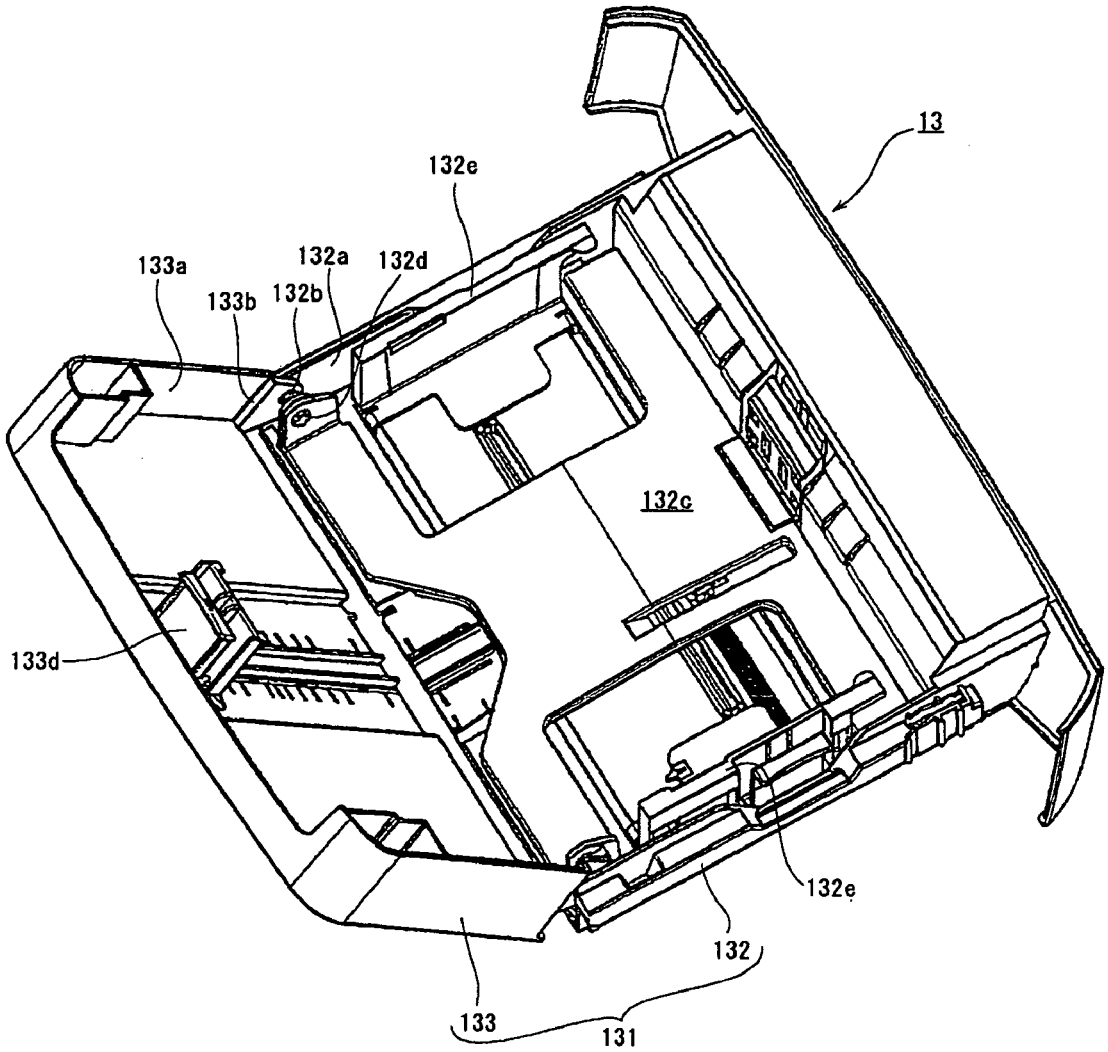

【Fig. 8】
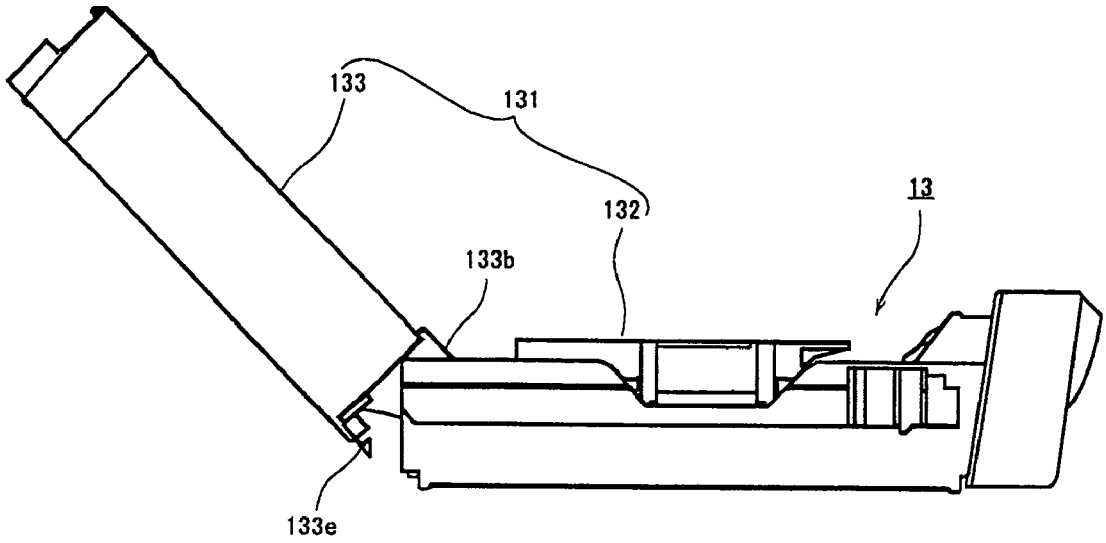
【Fig. 9】
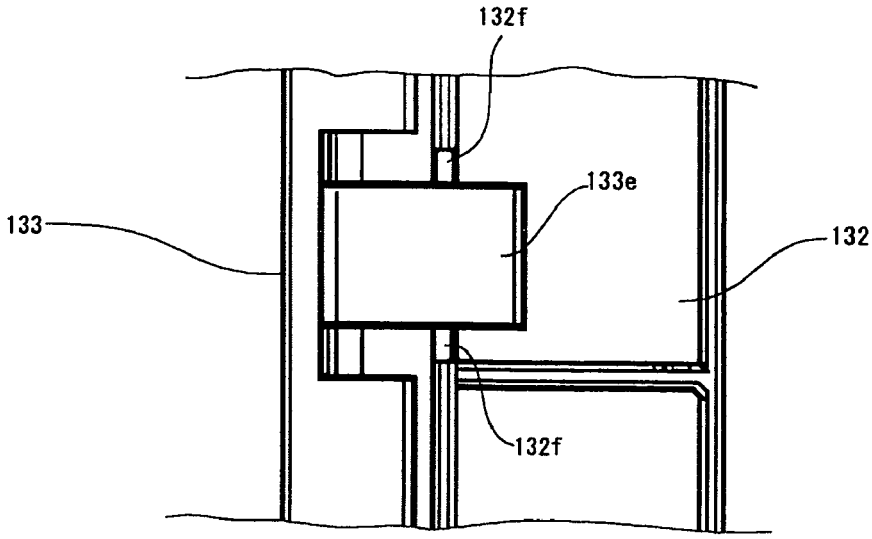

【Fig. 1 0】
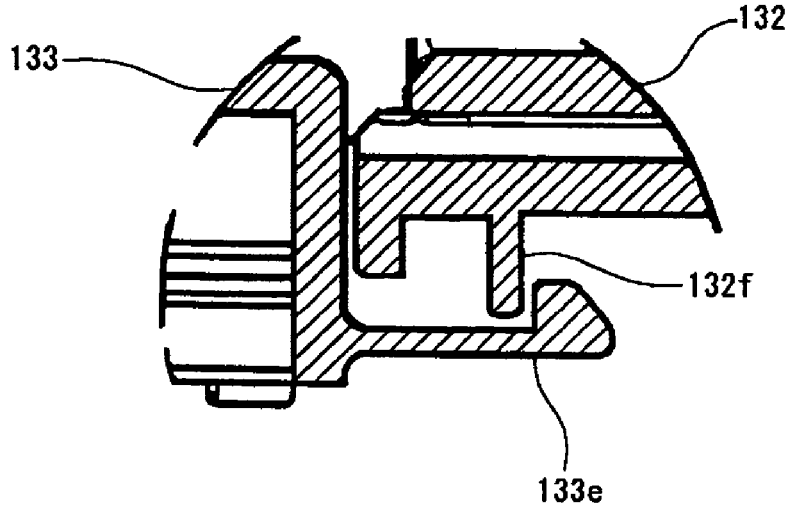

【Fig. 1 1】
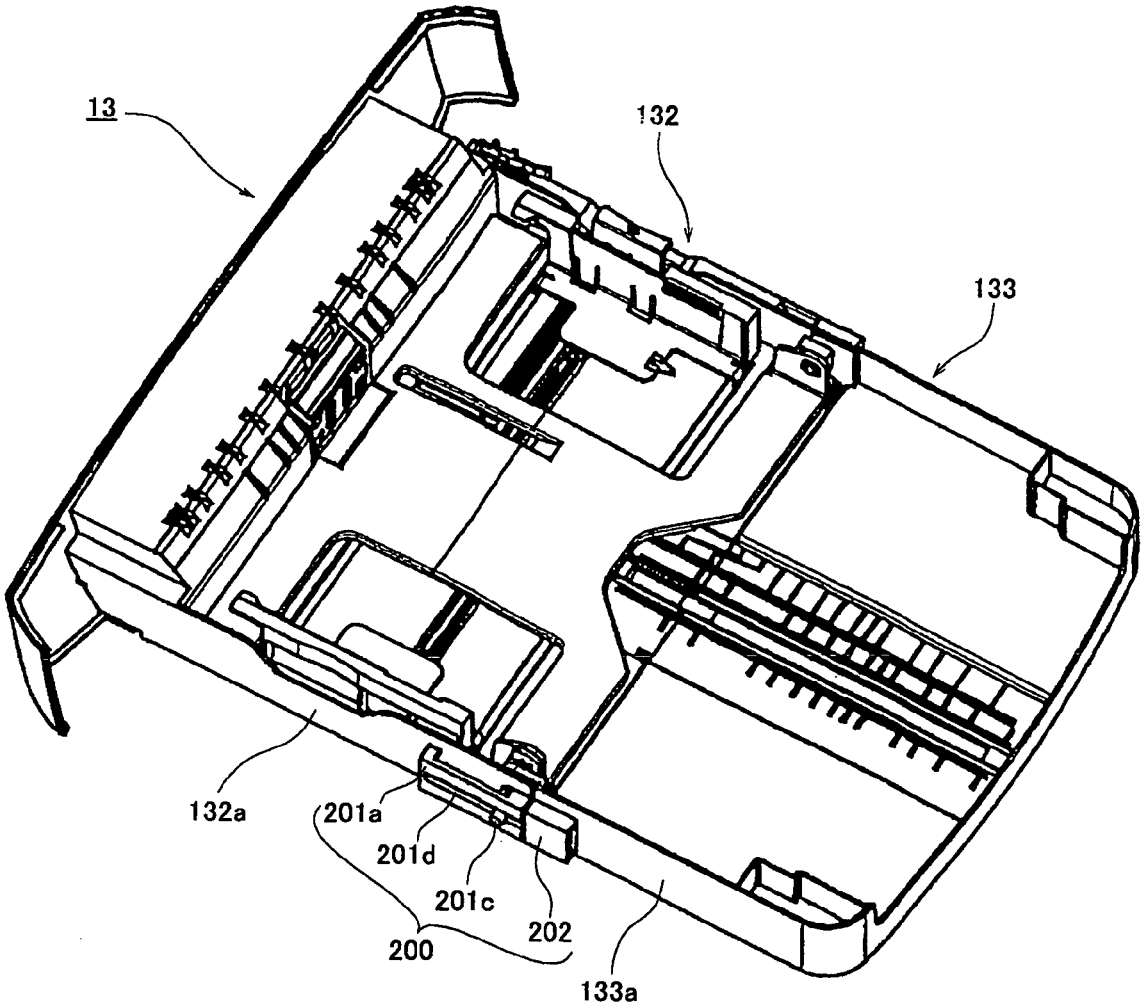

【Fig. 1 2】
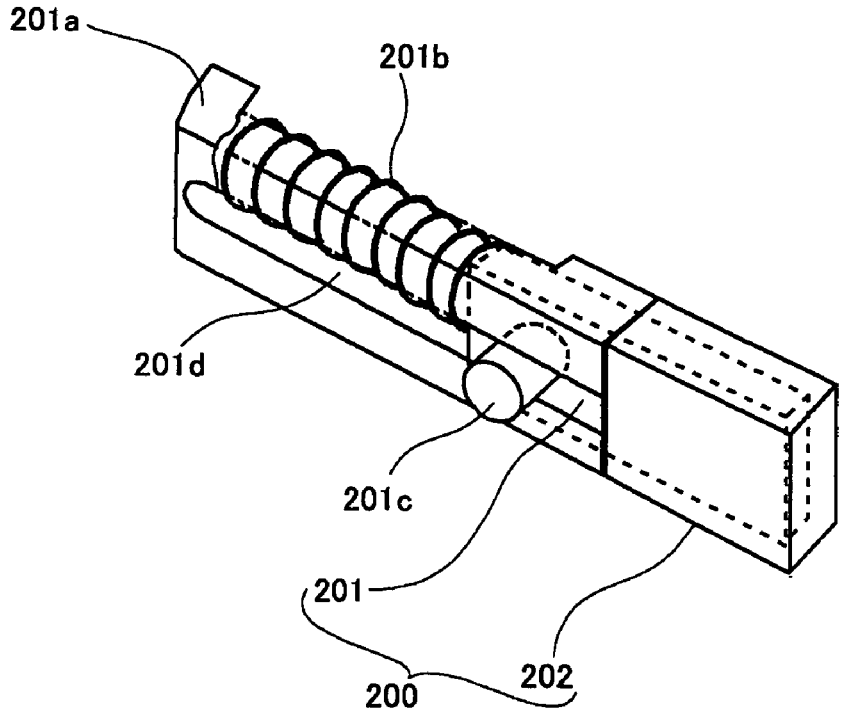
【Fig. 1 3】
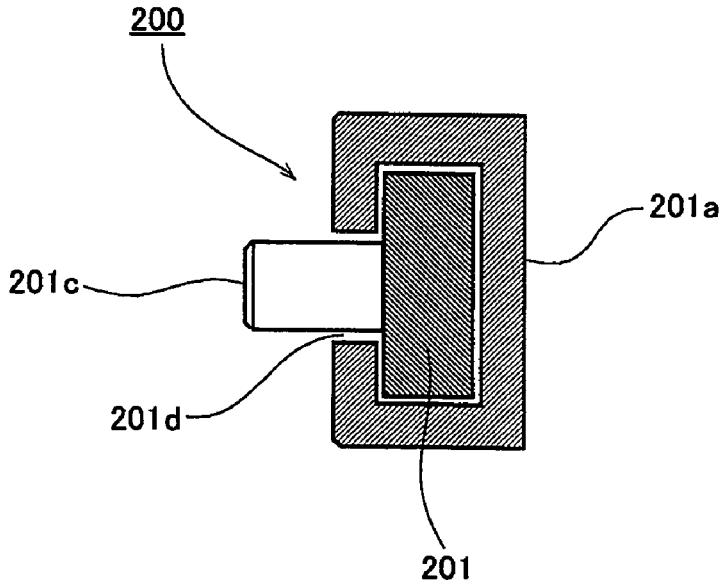

【Fig. 1 4】
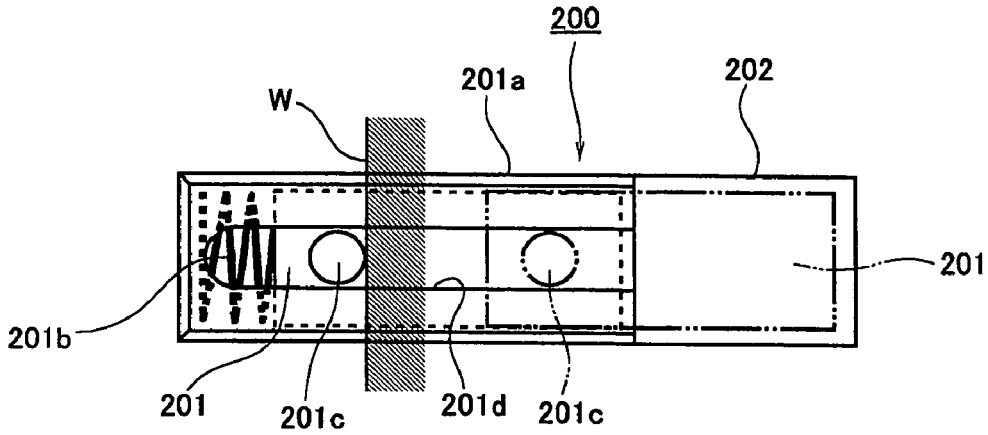

PAPER FEED CASSETTE FOR IMAGE FORMING APPARATUS

FIELD OF THE INVENTION

The present invention relates to a paper feed cassette for an image forming apparatus comprising a storage box for storing stacked recording mediums which is detachably loaded into the image forming apparatus body.

BACKGROUND OF THE INVENTION

Generally, a paper feed device for various image forming apparatuses such as electrophotographic copiers and printers is provided with a paper feed cassette that is capable of carrying a number of recording mediums. The recording mediums drawn from the paper feed cassette are conveyed through a predetermined paper feed path to a transfer zone in an image carrier of a photosensitive drum which produces an electrostatic latent image.

Such paper feed cassette used for the image forming apparatus generally has a storage box for storing a number of stacked recording mediums. The storage box formed of such paper feed cassette is detachably loaded into the image forming apparatus body so that the storage box can be easily supplied with recording mediums by removing the paper feed cassette from the image forming apparatus body.

Alternatively, in a recent downsized and light-weighted image forming apparatus, a part of the storage box for the paper feed cassette is exposed outside from the image forming apparatus when the paper feed cassette is loaded into the image forming apparatus body (cf. Japanese Patent Unexamined Publication No. 5-66621). Especially, the paper feed cassette having the above mentioned large external exposed portion has a possibility of being improperly handled such that the whole apparatus is lifted up by gripping the external exposed portion of the paper feed cassette. It is necessary to take preventive measures for such improper handling. Otherwise, when the user tries to detach the paper feed cassette from the apparatus to reload the recording medium, the user may accidentally lift the whole apparatus instead. This may cause damage to the paper feed cassette and increase the risk of the whole apparatus falling.

Thus, the object of the present invention is to provide a paper feed cassette for an image forming apparatus which can appropriately prevent the paper feed cassette, which projects from the image forming apparatus body and is exposed outside, from being damaged so that the risk of the whole apparatus falling is avoided.

SUMMARY OF THE INVENTION

In order to accomplish the object of the present invention, in the paper feed cassette for the image forming apparatus according to claim 1 of the present invention, the storage box for storing stacked recording mediums is detachably loaded into the image forming apparatus body, where a part of the storage box is exposed outside from the image forming apparatus body. The storage box consists of a two-separated structure or a two-part structure. One part of the two-part structure is releasably coupled to the other part thereof.

In the above described paper feed cassette for the image forming apparatus according to claim 1 of the present invention, when an improper handling is performed such that the whole image forming apparatus is lifted up by gripping the external exposed portion of the paper feed cassette that is loaded into the image forming apparatus body, each part of the two-part structure of the storage box is separated by the lifting up force to thereby release the lifting up force so that the above mentioned improper handling is avoided. Therefore, the paper feed cassette which is exposed outside from the image forming apparatus is prevented from being damaged so that the risk of the whole apparatus falling is avoided beforehand. Further, the reliability of the paper feed cassette and the image forming apparatus is significantly improved even as a simple structure.

Additionally, in the paper feed cassette for the image forming apparatus according to claim 2 of the present invention, the two-part structure of the storage box according to claim 1 comprises an in-apparatus mounting portion which is stored into the image forming apparatus body when the storage box is loaded into the image forming apparatus body and an out-apparatus mounting portion which is exposed outside of the image forming apparatus body. The out-apparatus mounting portion formed of the storage box is pivotably and releasably coupled to the in-apparatus mounting portion through a rotational support mechanism.

In the above described paper feed cassette for the image forming apparatus according to claim 2 of the present invention, the in-apparatus mounting portion and the out-apparatus mounting portion in the storage box are integrally coupled in normal use, but if the improper handling is performed such that the whole image forming apparatus is lifted up by gripping the out-apparatus mounting portion of the paper feed cassette which is loaded into the image forming apparatus body, the out-apparatus mounting portion is sprung up and pivoted against the in-apparatus mounting portion thereby to releasing the lifting up force so that the improper handling is avoided.

In the paper feed cassette for the image orming apparatus according to claim 3 of the present invention comprises a lock mechanism which keeps the in-apparatus mounting portion and the out-apparatus mounting portion of the two-part structure according to claim 2 to be integrally coupled with respect to a load equal to or less than a reference load value in the stacking direction of recording mediums, and releases the in-apparatus mounting portion and the out-apparatus mounting portion from being integrally coupled with respect to a load more than the reference load value.

In the above described paper feed cassette for The image forming apparatus according to claim 3 of the present invention, the in-apparatus mounting portion and the out-apparatus mounting portion are integrally coupled by a hold facility of the lock mechanism in normal use, but when the paper feed cassette is loaded into the image forming apparatus body, and improper handling is performed such that the whole image forming apparatus is lifted up by gripping the out-apparatus mounting portion of the storage box and the lifting up force exceeds the reference load value, the holding force of the lock mechanism is released thereby to spring up and pivot the out-apparatus mounting portion against the in-apparatus mounting portion so that the lifting up force is released. Therefore, the above mentioned improper handling is avoided.

Further, in the paper feed cassette for the image forming apparatus according to claim 4 of the present invention, the reference load value of the lock mechanism according to claim 3 is set to a larger value than the load value which is required for lifting up the out-apparatus mounting portion when recording mediums are stored in the storage box.

In the above described paper feed cassette for the image forming apparatus according to claim 4 of the present invention, although recording-mediums are stored in the storage box, provided that the reference load value has been set to a value larger than the weight of the recording mediums which are stored in the storage box, the lock mechanism which locks the in-apparatus mounting portion to the out-apparatus mounting portion is not released so that the in-apparatus mounting portion and the out-apparatus mounting portion are kept integrally coupled when in normal use, therefore the whole storage box is rigidly maintained.

Further, in the paper feed cassette for the image forming apparatus according to claim 5 of the present invention, the reference load value of the lock mechanism according to claim 3 is set to a lower value than the load value which is required for lifting up the out-apparatus mounting portion when the storage box is loaded into the image forming apparatus body.

In the above described paper feed cassette for the image forming apparatus according to claim 5 of the present invention, when improper handling is performed such that the whole image forming apparatus is lifted up by gripping the out-apparatus mounting portion of the storage box which is loaded into the image forming apparatus, the lock mechanism which keeps the in-apparatus mounting portion and the out-apparatus mounting portion integrally couple is certainly released and only the out-apparatus mounting portion is pivoted upwardly to thereby release the lifting up force so that the improper handling of the apparatus is avoided.

Furthermore, the paper feed cassette for the image forming apparatus according to claim 6 of the present invention comprises a lock mechanism which releases the in-apparatus mounting portion and the out-apparatus mounting portion from being integrally coupled when the storage box according to claim 2 is loaded into the image forming apparatus body, and alternatively keeps the in-apparatus mounting portion and the out-apparatus mounting portion integrally coupled when the storage box is removed from the image forming apparatus body.

In the above described paper feed cassette for the image forming apparatus according to claim 6 of the present invention, when the paper feed cassette is removed from the image forming apparatus body, the in-apparatus mounting portion and the out-apparatus mounting portion of the storage box are integrally coupled by the hold facility of the lock mechanism so that a desirable handleability is achieved. On the other hand, when the paper feed cassette is loaded into the image forming apparatus, the lock mechanism is released and the out-apparatus mounting portion is freely pivoted against the in-apparatus mounting portion of the storage box so that when the improper handling is performed such that the whole image forming apparatus is lifted up by gripping the out-apparatus mounting portion of the storage box which is loaded into the image forming apparatus body, the out-apparatus mounting portion is sprung up and pivoted against the in-apparatus mounting portion because the lock mechanism is released by the lifting up force thereby to release the lifting up force of the whole apparatus so that the above mentioned improper handling is avoided.

In the paper feed cassette for the image forming apparatus according to claim 7 of the present invention, the lock mechanism according to claim 6 comprises an engaging member which can reciprocate between the in apparatus mounting portion and the out-apparatus mounting portion, and a locking member which is provided in any one of the in-apparatus mounting portion or the out-apparatus mounting portion and keeps the in-apparatus mounting portion and the out-apparatus mounting portion integrally coupled by fitting the engaging member therein. The engaging member is abutted on the image forming apparatus and removed from the locking member when the storage box is loaded into the image forming apparatus body.

In the above described paper feed cassette for the image forming apparatus according to claim 7 of the present invention, when the paper feed cassette is removed from the image forming apparatus body, the engaging member is fitted in the locking member through the lock mechanism so that the out-apparatus mounting portion is integrally coupled to the in-apparatus mounting portion of the storage box. In the other hand, when the paper feed cassette is loaded into the image forming apparatus body, the fitting of the engaging member and the locking member is released so that the out-apparatus mounting portion is freely pivoted against the in-apparatus mounting portion. Therefore, when the improper handling is performed such that the whole image forming apparatus is lifted up by gripping the out-apparatus mounting portion of the storage box, the out-apparatus mounting portion is removed from the in-apparatus mounting portion thereby to release the lifting up force so that the above mentioned improper handling is avoided.

BRIEF DESCRIPTION OF THE DRAWINGS

FIG. 1 is the schematic longitudinal sectional view which shows the schematic structure of the printer according to the first embodiment of the present invention;

FIG. 2 is the outline perspective view of the paper feed cassette which is used for the printer as shown in FIG. 1 according to the first embodiment of the present invention;

FIG. 3 is the side view of the paper feed cassette as shown in FIG. 2;

FIG. 4 is the exploded perspective view of the paper feed cassette as shown in FIG. 2;

FIG. 5 is the outline perspective view which shows the enlarged one side of the rotational support mechanism of the paper feed cassette as shown in FIG. 2;

FIG. 6 is the outline perspective view which shows the enlarged other side of the rotational support mechanism of the paper feed cassette as shown in FIG. 2;

FIG. 7 is the outline perspective view which shows the pivoting state of the paper feed cassette as shown in FIG. 2;

FIG. 8 is the side view which shows the pivoting state of the paper feed cassette as shown in FIG. 7;

FIG. 9 is the bottom plan view which shows the enlarged lock mechanism of the paper feed cassette as shown in FIG. 2;

FIG. 10 is the longitudinal sectional view which shows the structure of the lock mechanism of the paper feed cassette as shown in FIG. 9;

FIG. 11 is the outline perspective view which shows the paper feed cassette according the second embodiment of the present invention;

FIG. 12 is the outline perspective view of the enlarged lock mechanism used for the paper feed cassette as shown in FIG. 11;

FIG. 13 is the cross-sectional view which shows the structure of the lock mechanism as shown in FIG. 12; and FIG. 14 is the side view which shows the lock mechanism as shown in FIG. 12.

DETAILED DESCRIPTION OF THE INVENTION

Hereinafter the embodiments of the present invention are described in detail based on drawings, before it, the overall structure of the image forming apparatus is described in general, for example, by reference to the laser printer.

In laser printer as shown in FIG. 1, image information transmitted from an external computer via the video controller (not shown) is imaged in spots matrix as light modulation information 111 by laser emitting write part 11 on photosensitive drum 121 serving as an image carrier which is provided in process cartridge 12. The light spots are reciprocally scanned in axial (main scanning direction) of photosensitive drum 121 so that an electrostatic latent image corresponding to the formed image on the photosensitive drum 121 is formed. Then, a developer (toner) from developing device 122, which is also integrally provided in the process cartridge 12, is supplied to the electrostatic latent image on the photosensitive drum 121 so that an unfixed toner image is formed.

Meanwhile, paper feed cassette 13 formed of the paper feed means is disposed on the lower side of the apparatus. The desired sized recording papers (recording mediums) P are stacked and stored in paper feed cassette 13. The structure of paper feed cassette 13 is described in detail afterwards. Then, the recording papers P are drawn from paper feed roller 13*a* and fed into the transfer zone which faces the above mentioned photosensitive drum 121 with appropriate timing.

Transfer roller 15 serving as a contact transfer subject is disposed in contact with the surface of the photosensitive drum 121 on the transfer zone of photosensitive drum 121. Transfer bias is applied to the transfer roller 15 and the transfer bias affects such that the unfixed toner image on photosensitive drum 121 is electrostatically transferred to recording paper P. Further, the remained toner in the photosensitive drum 121 is scraped away by the scraping force of cleaning blade 123 which is disposed in pressure contact with the surface of the photosensitive drum 121 after the transfer is completed.

Further, recording paper P which carries the unfixed toner by the above mentioned transfer operation is conveyed toward fixing device 16 which is disposed adjacent to the process cartridge 12. The fixing device 16 comprises fixing roller 161 serving as a heater and pressure roller 162. The unfixed toner on recording paper P is heated and fused by heating and fixing operation of the fixing roller 161 and the pressure roller 162 so that the toner image is securely fixed on the recording paper P. The recording paper P, which is fixed with the toner image by such heating and fixing operation, is ejected onto paper ejecting tray 18 by paper ejecting roller 171 of paper ejecting outlet 17 which is provided on the upper portion (as shown in the figure) of the image forming apparatus body.

The paper ejecting tray 18 holds stacked recording papers P which are ejected after fixing, where fixed paper ejecting tray 181 is upwardly extended diagonally toward in paper feed direction (right direction as shown in FIG. 1) from the just under the position of the paper ejecting outlet 17 of the image forming apparatus by utilizing a portion of the cover of the image forming apparatus, and movable paper ejecting tray 182 is pivotally connected at the end of the fixed paper ejecting tray 181 in the paper feed direction. The movable paper ejecting tray 182 is opened/closed between the opened use position (as shown in FIG. 1) and the closed storage position (not shown), and the upper space of the fixed paper ejecting tray 181 is opened/closed by the movable paper ejecting tray 182.

As shown in FIG. 2, FIG. 3 and FIG. 4, the above described paper feed cassette 13 comprises storage box 131 having generally shallow flat rectangular shape for storing the above mentioned stacked recording papers P. The storage box 131 can be removed from the image forming apparatus body so that recording papers P can be supplied to the storage box 131 of paper feed cassette 13 when the storage box 131 for the paper feed cassette 13 is removed from the image forming apparatus body.

Additionally, when the storage box 131 for the paper feed cassette 13 of the present embodiment is loaded into the image forming apparatus (as shown in FIG. 1), the front side in the cassette loading direction (the left side as shown in FIG. 1) is exposed outside from the image forming apparatus body. The reason is that the paper feed cassette 13 is sized to be able to use recording papers P which have the established size while the image forming apparatus body is downsized and light-weighted in the longitudinal direction of the paper feed cassette 13.

The storage box 131 comprises the two-separated structure or a two-part structure which is separated in the loading direction of the storage box 131. When the storage box 131 is loaded into the image forming apparatus body, the out-apparatus mounting portion 133 which is exposed outside from the image forming apparatus is relatively pivoted against the in-apparatus mounting portion 132 which is stored into the image forming apparatus body via the rotational support mechanism.

That is to say, the rotational support mechanism for the out-apparatus mounting portion 133 and the in-apparatus mounting portion 132 which constitute the two-part structure of the storage box 131 is provided with rotational support pin 132*b* and 132*b*, respectively such that each rotational support pin 132*b* and 132*b* projects from each side wall 132*a* and 132*a* toward inside of the paper width direction (especially as shown in FIG. 4, FIG. 5 and FIG. 6). On the other hand, connector plate 133*b* and 133*b* which project toward the paper feed direction are provided respectively at the opening edge portion of each leading edge of both side wall 133*a* and 133*a* of the out-apparatus mounting portion 133, wherein grooved rotational hole 133*c* and 133*c* which are formed at each leading edge portion of the connector plate 133*b* and 133*b* are pivotally fitted to the rotational support pin 132*b* of the in-apparatus mounting portion 132.

The rotational support pin 132*b* of the present embodiment has a cross-section such that both sides of circular cross section are cut off with a perpendicular planar surface, while a groove portion corresponding the thickness between both side planar surfaces of the rotational support pin 132*b* is formed to open outwardly in the grooved rotational hole 133*c* of the connector plate 133*b*. When the out-apparatus mounting portion 133 is standing generally in the vertical direction, the out-apparatus mounting portion 133 is pivoted to a working position after the groove portion of the grooved rotational hole 133*c* is inserted through the out-apparatus mounting portion 133 along both side planer surfaces of the rotational support pin 132*b* in the general vertical direction so that the grooved rotational hole 133*c* can be pivoted for the rotational support pin 132*b* and fitted to the rotational support pin 132*b* so as not to be removed in the longitudinal direction of the paper feed cassette 13.

When the paper feed cassette 13 is loaded into the image forming apparatus, especially as shown in FIG. 7 and FIG. 8, the in-apparatus mounting portion 132 is kept to securely fit into the image forming apparatus, while the out-apparatus mounting portion 133 is pivotally coupled to the in-apparatus mounting portion 132 in the vertical direction to which the recording papers P are stacked and is sprung upwardly against the in-apparatus mounting portion 132.

In addition, middle support plate 132*c* which supports to push up stacked recording papers P is disposed inside the in-apparatus mounting portion 132 as well as conventional products and the leading edge portion of the middle support plate 132*c* in the paper feed direction is biased to be lifted upwardly by the coil spring (not shown), wherein rotational support pin 132*d* of the middle support plate 132*c* is disposed to approximately correspond positionally to the rotational support pin 132*b* formed of the rotational support mechanism for the out-apparatus mounting portion 133 and the in-apparatus mounting portion 132 in the cassette loading direction.

A pair of side plate 132*e* and 132*e* for positioning the side portion of the recording papers P which are stored in the paper feed cassette 13 is standing upright to be able to reciprocate in the paper width direction inside the in-apparatus mounting portion 132, and rear end plate 133*d* for positioning the rear end portion of the stored recording papers P in the paper feed direction is standing upright to be able to reciprocate in the paper length direction in the out-apparatus mounting portion 133.

The out-apparatus mounting portion 133 and the in-apparatus mounting portion 132 are kept to be integrally coupled in normal use by two lock mechanisms disposed at each bottom plate thereof. Each lock mechanism especially as shown in FIG. 9 and FIG. 10, the distal detent projection of engaging hook 133*e* which is provided to extend from the side portion of the bottom plate of the out-apparatus mounting portion 133 is fitted to the leading edge portion of the locking plate 132*f* which is stood upright at the side portion of the bottom plate of the in-apparatus mounting portion 132. The engaging hook 133*e* is kept to fit to the locking plate 132*f* with respect to load value W1 equal to or less than a predetermined reference load value Ws so that the out-apparatus mounting portion 133 and the in-apparatus mounting portion 132 are kept integrally coupled. On the other hand, the engaging hook 133*e* and the locking plate 132*f* are released from being integrally coupled with respect to load value W2 more than a predetermined reference load value Ws so that the out-apparatus mounting portion 133 and the in-apparatus portion 132 are released from being integrally coupled so that the out-apparatus mounting portion 133 is removed from the in-apparatus mounting portion 132.

That is to say, the reference load value Ws is set to the lock mechanism such that the reference load value Ws is more than the load value W1 minimally required to lift by hand the out-apparatus mounting portion 133 when the stacked recording papers P are stored in the storage box 131 (Ws>W1), and is less than the load value W2 minimally required to lift by hand the out-apparatus mounting portion 133 when the storage box 131 is loaded into the image forming apparatus body (Ws<W2). For example, if the load value minimally required lifting by hand the out-apparatus mounting portion 133 when the stacked recording papers P are stored in the storage box 131 is 1 Kg (W1), the reference load value Ws of the lock mechanism is set to equal to or more than a value for 2 Kg (Ws). Alternatively, if the load value minimally required to lift by hand the out-apparatus mounting portion 133 when the storage box 131 is loaded into the image forming apparatus body 131 is 6 Kg (W2), the reference load value Ws of the lock mechanism is set to equal to or less than a value for 5 Kg (Ws).

When such paper feed cassette 13 according to the present embodiment is in normal use, the in-apparatus mounting portion 132 and the out-apparatus mounting portion 133 of the storage box 131 are kept integrally coupled by the lock mechanism 132*f* and 133*e*. On the other hand, when an improper handling is performed such that the whole image forming apparatus is lifted up by gripping the out-apparatus mounting portion 133 of the paper feed cassette which is loaded into the image forming apparatus body, the lock mechanism 132*f* and 133*e* which lock the in-apparatus mounting portion 132 and the out-apparatus mounting portion 133 by the lifting up force is released and only the out-apparatus mounting portion 133 is upwardly pivoted thereby releasing the lifting up force so that the above mentioned improper handling is avoided.

Especially, in the present embodiment, the reference load value Ws for the lock mechanism 132*f* and 133*e* is set to more than the load value W1 at which the out-apparatus mounting portion 133 is lifted up by hand when the recording papers P are stored in the storage box 131. Therefore, even if the recording papers P are stored in the storage box 131, the in-apparatus mounting portion 132 and the out-apparatus mounting portion 133 are kept integrally coupled. Also the reference load value Ws for the lock mechanism 132*f* and 133*e* is set to less than W2 at which the out-apparatus mounting portion 133 is lifted up by hand when the storage box 131 is loaded into the image forming apparatus body so that the improper handling such that the whole apparatus is lifted up by gripping the paper feed cassette 13 which is loaded into the image forming apparatus body is certainly avoided.

Next, in the second embodiment as shown in FIG. 11 (the same components as that of the above described first embodiment are given the same reference letters or numerals), lock mechanism 200 is an alternative to the lock mechanism 132*f* and 133*e* in the above described first embodiment, which releasably couples the in-apparatus mounting portion 132 and the out-apparatus mounting portion 133 formed of the two-part structure is provided on each side wall 132*a* and 133*a* of the in-apparatus mounting portion 132 and the out-apparatus mounting portion 133 formed of the storage box 131, respectively. The lock mechanism 200 comprises engaging member 201 which has elongate plate shape and is provided in the in-apparatus mounting portion 132, and locking member 202 which has hollow box shape and is provided in the out-apparatus mounting portion 133 such that the engaging member 201 is accepted and fitted into the locking member 202 as shown in FIG. 12, FIG. 13 and FIG. 14.

The engaging member 201 is supported to be able to linearly reciprocate in the paper feed direction by elongate guide rail 201*a* which extends in the paper feed direction, wherein the leading edge portion of the engaging member 201 is biased to project toward the locking member 202 by pressing force in the paper feed direction of coil spring 201*b* serving as biasing means which is mounted inside the guide rail 201*a*.

The above described locking member 202 is formed from the hollow box shape body which is provided on side wall 133*a* of the out-apparatus mounting portion 133, wherein the leading edge portion of the engaging member 201 is inserted into the locking member 202 in the paper feed direction by the biasing force of the coil spring 201*b*.

Then, when the leading edge portion of the engaging member 201 is inserted into the locking member 202 and the engaging member 201 is engaged with the locking member 202 (cf. FIG. 12), the lock mechanism 200 is activated so that the out-apparatus mounting portion 133 is fixed to the in-apparatus mounting portion 132 so as not to pivot and the out-apparatus mounting portion 133 and the in-apparatus mounting portion 132 are kept integrally coupled. On the other hand, when the engaging member 201 is pulled out from the locking member 202 (cf. FIG. 14), the lock mechanism 200 is released and the out-apparatus mounting portion 133 can be pivoted against the in apparatus mounting member 132 via the rotational support mechanism so that both portion 132 and 133 are released from being integrally coupled.

Further, button clamp stopper pin 201*c* stands upright and projects in the paper width direction on the outer surface of the engaging member 201, wherein the button clamp stopper pin 201*c* projects outwardly through elongate slide opening groove 201*d* which is formed on the guide rail 201*a* in the paper width direction. The slide opening groove 201*d* extends over the appropriate length in the paper conveying direction, and the button clamp stopper pin 201*c* is linearly reciprocated along the slide opening groove 201*d*.

Meanwhile support wall W (cf. FIG. 14) on which the button clamp stopper pin 201*c* is abutted when the paper feed cassette 13 is loaded into the image forming apparatus is stood upright. Thus, when the storage box 131 of the paper feed cassette 13 is loaded into the image forming apparatus body, the button clamp stopper pin 201*c* is abutted on and accepted to the support wall W in the image forming apparatus in the paper conveying direction. When the storage box 131 of the paper feed cassette 13 is pushed so as to be further inserted into the image forming apparatus body, the engaging member 201 is moved in the direction to which the engaging member 201 is relatively pulled out from the locking member 202.

Additionally, when the storage box 131 of the paper feed cassette 13 is completely loaded into the image forming apparatus, the engaging member 201 is entirely received inside the guide rail 201*a* so that the lock mechanism 200 is released as shown in the full line of FIG. 14. Therefore, the engaging member 201 is kept completely removed from the locking member 202 and the in-apparatus mounting portion 132 and the out-apparatus mounting portion 133 is released from being integrally coupled so that the out-apparatus mounting portion 133 which projects and is exposed outwardly from the image forming apparatus body is freely-pivotally coupled to the in-apparatus mounting portion 132 which is stored into the image forming apparatus body via the rotational support mechanism.

Thus, in the present embodiment, when the storage box 131 of the paper feed cassette 13 is removed from the image forming apparatus body, the engaging member 201 of the in-apparatus mounting portion 132 is inserted into and fitted in the locking member 202 (cf. FIG. 12) so that the in-apparatus mounting portion 132 and the out-apparatus mounting portion 133 are kept integrally coupled. On the other hand, when the storage box 131 of the paper feed cassette 13 is loaded into the image forming apparatus body, the engaging member 201 is pulled out from the locking member 202 (cf. FIG. 14) so that the in-apparatus mounting portion 132 and the out-apparatus mounting portion 133 is released from being integrally coupled.

That is to say, according to the second embodiment, when the cassette 13 is removed from the image forming apparatus body, the in-apparatus mounting portion 132 and the out-apparatus mounting portion 133 are kept securely and integrally coupled by the lock mechanism 200 so that the individual handleability of the paper feed cassette 13 is improved. Additionally, when the paper feed cassette 13 is loaded into the image forming apparatus body, the out-apparatus mounting portion 133 can be completely and freely pivoted against the in-apparatus mounting portion 132 so that the improper handling such that the whole image forming apparatus is lifted up by gripping the out-apparatus mounting portion 133 is appropriately avoided.

As mentioned above, the embodiments of the invention by the present inventor is concretely described, however, it is to be understood that the present invention is not intended to be limited to the above described embodiments, and various changes may be made therein without departing from the spirit of the present invention.

The present invention is applied to a printer in the above described embodiments for example, and the present-invention also can be applied to a paper feed cassette for other image forming apparatuses such as a copier.

The above described paper feed cassette according to the present invention can be broadly applied to various image forming apparatuses such as a printer, a copier and so on.

What is claimed is:

1. A paper feed cassette for an image forming apparatus comprising:

a storage box for storing stacked recording mediums which is detachably loaded into the image forming apparatus body, wherein a part of the storage box is exposed outside from the image forming apparatus body, wherein a portion for placing the recording mediums of the storage box comprises a two-part structure, and wherein one-part of the structure is pivotably coupled to the other-part thereof and wherein the two-part structure of the storage box are kept to be integrally coupled without pivoting in normal use, but when an improper handling is performed to the storage box, only one of the two-part structure pivots.

2. The paper feed cassette for an image forming apparatus according to claim 1, wherein the two-part structure comprises an in-apparatus mounting portion which is stored into the image forming apparatus body when the storage box is loaded into the image forming apparatus body and an out-apparatus mounting portion which is exposed outside from the image forming apparatus body, and wherein the out-apparatus mounting portion formed of the storage box is pivotably coupled to the in-apparatus mounting portion via a rotational support mechanism.

3. The paper feed cassette for an image forming apparatus according to claim 2, wherein the paper feed cassette comprises a lock mechanism which keeps the in-apparatus mounting portion and the out-apparatus mounting portion of the two-part structure integrally coupled with respect to a load equal to or less than a reference load value in the recording medium stacking direction and does not keep the in-apparatus apparatus mounting portion and the out-apparatus mounting portion of the two-part structure integrally coupled with respect to a load more than the reference load value.

4. The paper feed cassette for an image forming apparatus according to claim 3, wherein the reference load value of the lock mechanism is set to a value more than the load value minimally required to lift up the out-apparatus mounting portion when the recording mediums are stored into the storage box.

5. The paper feed cassette for an image forming apparatus according to claim 3, wherein the reference load value of the lock mechanism is set to a value less than the load value minimally required to lift up the out-apparatus mounting portion when the storage box is loaded into the image forming apparatus body.

6. The paper feed cassette for an image forming apparatus according to claim 2, wherein the paper feed cassette comprises a lock mechanism which releases the in-apparatus mounting portion and the out-apparatus mounting portion from being integrally coupled when the storage box is loaded into the image forming apparatus and keeps the in-apparatus mounting portion and the out-apparatus mounting portion integrally coupled when the storage box is removed from the image forming apparatus body.

7. The paper feed cassette for an image forming apparatus according to claim 6, wherein the lock mechanism comprises an engaging member which can reciprocally move between the in-apparatus mounting portion and the out-apparatus mounting portion and a locking member which is provided in either the in-apparatus mounting portion or the out-apparatus mounting portion and keeps the in-apparatus mounting portion and the out-apparatus mounting portion integrally coupled by accepting the engaging member and fitting it therein, and wherein the engaging member abuts on the image forming apparatus and is removed from the locking member when the storage box is loaded into the image forming apparatus body.

8. The paper feed cassette for an image forming apparatus according to claim 1, wherein the two-part structure of the storage box are kept to be integrally coupled without pivoting when the storage box is removed from the image forming apparatus in normal use, but when the storage box is loaded into the image forming apparatus and an improper handling is performed as to lift the portion exposed outside from the image forming apparatus body, only one of the two-part structure pivots upwardly.

* * * * *